US006050470A

United States Patent [19]

Feesenmayr et al.

[11] Patent Number: 6,050,470

[45] Date of Patent: Apr. 18, 2000

[54] SHEET-STAPLING APPARATUS

[75] Inventors: Manfred Feesenmayr, Ostfildern; Arno Ebner, Ammerbuch; Jürgen Ries, Ostfildern, all of Germany

[73] Assignee: Eastman Kodak Company, Rochester, N.Y.

[21] Appl. No.: 09/084,744

[22] Filed: May 26, 1998

[30] Foreign Application Priority Data

May 28, 1997 [DE] Germany ..... 197 22 298

[51] Int. Cl.[7] ..... B27F 7/21

[52] U.S. Cl. ..... 227/78; 227/101; 227/111

[58] Field of Search ..... 227/78, 110, 111, 227/101, 1, 156, 84; 270/37; 493/385

[56] References Cited

U.S. PATENT DOCUMENTS

| | | | |
|---|---|---|---|
| 3,735,978 | 5/1973 | Turner et al. | 271/178 |
| 4,516,714 | 5/1985 | Braun et al. | 227/78 |
| 4,750,661 | 6/1988 | Pane | 227/78 |
| 4,957,284 | 9/1990 | Brabant | 270/37 |
| 5,005,751 | 4/1991 | Radtke et al. | 227/111 |
| 5,018,656 | 5/1991 | Phelps | 227/84 |
| 5,160,089 | 11/1992 | Radtke et al. | 227/78 |
| 5,316,280 | 5/1994 | Watkiss | 270/37 |
| 5,662,318 | 9/1997 | Harada et al. | 227/111 |

FOREIGN PATENT DOCUMENTS

| | | |
|---|---|---|
| 38 39 297 A1 | 5/1990 | Germany . |
| 38 39 306 A1 | 5/1990 | Germany . |

*Primary Examiner*—Peter Vo
*Assistant Examiner*—Jim Calve
*Attorney, Agent, or Firm*—Clyde E. Bailey, Sr.

[57] ABSTRACT

In an apparatus (1) for stapling sheets (10) deposited in stacks, stapling devices (6 and 7) are attached to a pivotable support (3) which is movable from a locked operating position (position I) into an easily accessible service position (position II). The stapling devices (6 and 7) are attached in easily detachable fashion to holders (4 and 5) which are guided displaceably on the shaft (8) and can be set to different stapling positions by a follower mechanism. Attached releasably to each of the holders (4 and 5) is a mounting plate (44 and 45) on which the stapling devices (6 and 7), and all the components necessary for operation thereof, are releasably attached. The support (3) is movable into a position (position II) in which access is possible to the stapling devices (6 and 7) and the mounting plates (44 and 45) via a sheet stack depositing area (13) of the apparatus (1) which is accessible from outside the apparatus.

12 Claims, 3 Drawing Sheets

SHEET-STAPLING APPARATUS

FIELD OF THE INVENTION

The invention relates to an apparatus for stapling sheets which are deposited one on top of another in stacked form, such apparatus having a stapling device arranged inside a closed housing of the apparatus.

BACKGROUND OF THE INVENTION

German Offenlegungsschrift 38 39 297 and U.S. Pat. No. 5,005,751 disclose apparatus which, in combination with an upstream copier, serve to deposit the copied sheets output by the copier in stacked form in a depositing station. For this purpose, the sheets are collected in sets, for example, in a collecting station and are stapled by stapling devices which are associated with the collecting station and can be adjusted to various stapling positions. The stapled sheet stacks are then removed from the collecting station by means of a transport gripper, and delivered in stacked fashion onto a vertically movable depositing table. Because of their spatial association with the collecting station and because of the guide means for adjusting to different stapling positions, the stapling devices of these known apparatus are arranged in a stationary and externally inaccessible manner such that time-consuming disassembly is necessary in the event of a malfunction of the stapling devices or for maintenance thereof.

SUMMARY OF THE INVENTION

It is the object of this invention to configure a stapling apparatus in such a way that rapid and easy access to the stapling device is achieved.

According to the invention, this object is attained in that the stapling device is arranged on a movable support which can be locked in a first position associated with the operating position of the stapling device. The support is movable into a second position in which the stapling device is accessible for service purposes.

Advantageously, the support according to this invention is configured in such a way that it ensures the accurate positioning of two stapling devices in their operating positions but for maintenance purposes or in the event of a malfunction can easily be pivoted into a position in which rapid and easy access to the stapling devices is possible. The support according to the invention is arranged pivotably by a shaft mounted rotatably on the apparatus. In the operating position of the stapling devices, the support is advantageously lockable in a precise position, simultaneously both at the front and at the rear of the apparatus, by an actuation mechanism which can be operated from the front of the apparatus.

In an advantageous modification of the invention, the support has holders with mounting plates for releasably attaching the stapling devices, the holders being guided displaceably on the shaft and on a parallel guide, and adjustably in various stapling positions. Arranged on the holders are followers which, in each position of the support, are in positive engagement with a device for displacing the stapling devices into various stapling positions.

Advantageously, the support can be pivoted into a position in which the holders having the stapling devices are positioned in a stacking chamber for sheet stacks to be deposited, such chamber having to be accessible in any case for the removal of finished jobs and thus also allows access to the stapling devices which are temporarily positioned there.

BRIEF DESCRIPTION OF THE DRAWINGS

Further features and advantages are evident from the description of an embodiment of the invention depicted in the drawings, and from the subclaims. In the schematic drawings shown:

DETAILED DESCRIPTION OF THE INVENTION

Figure 1:
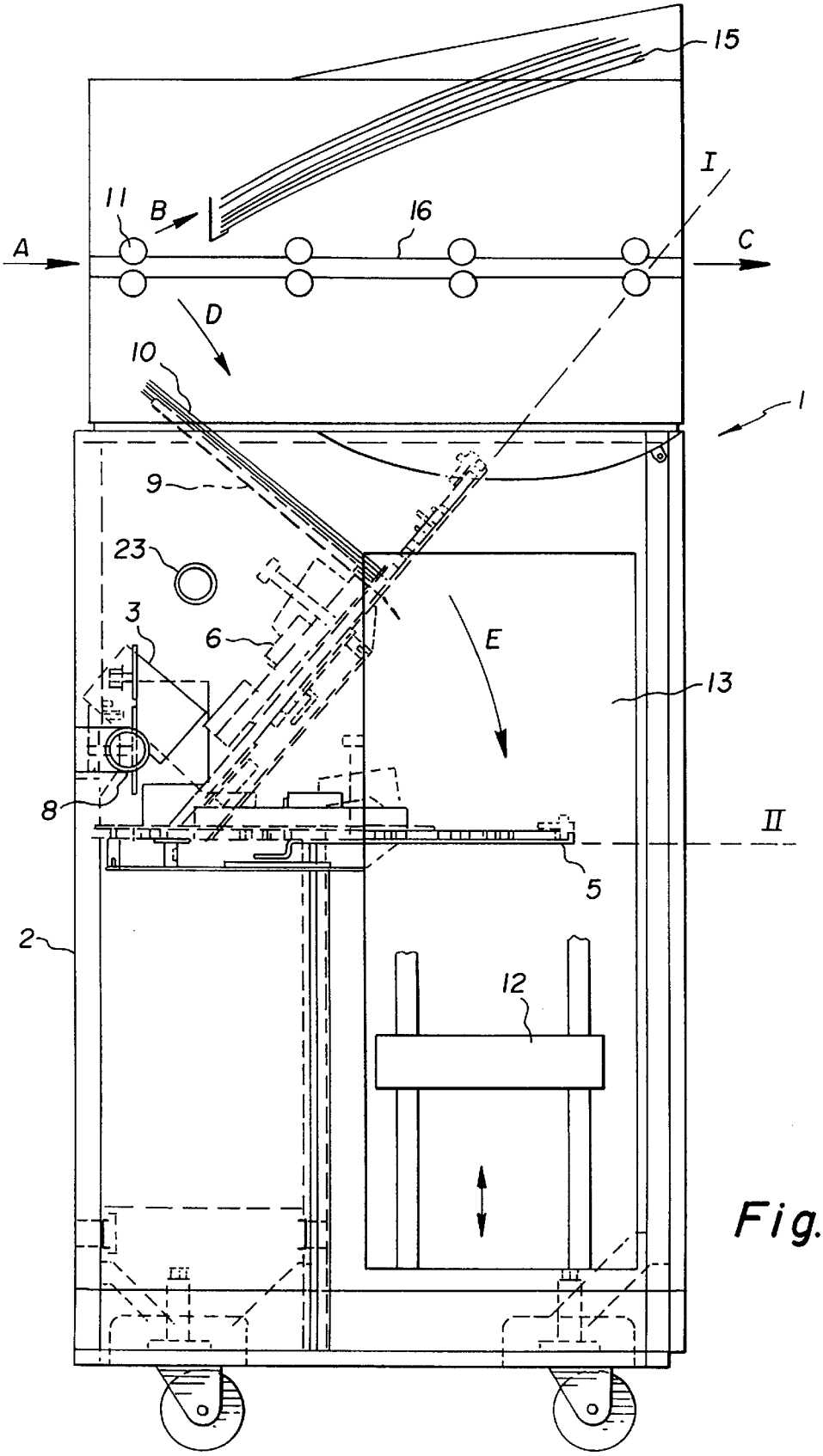
FIG. 1 is a front view of the device.

The device according to the invention is, for example, part of an apparatus 1 for depositing copied sheets output from a copier (not depicted) of known type, which are either output individually into an upper tray 15 or collected into sets in a collecting station 9 and stapled before being deposited. Apparatus 1 moreover has a substantially straight paper path 16 which serves to guide copied sheets through the apparatus 1 directly to a downstream apparatus of known type (not depicted), for example a high-capacity depositing mechanism. As FIG. 1 shows, the sheets output from the copier pass into apparatus 1 in the direction of the arrow "A" and are there transported further by transport rollers 11. Arranged after transport rollers 11 is a switcher of known type (not depicted) which guides the incoming sheet alternatively either in the direction of the arrow "B" into the upper tray 15, or via paper path 16 in the direction of the arrow "C" into a downstream apparatus, or in the direction of the arrow "D" into the collecting station 9.

The sheets entering into collecting station 9 in the direction of the arrow "D" slide on the depositing surface of collecting station 9, which is arranged pointing obliquely downward at an acute angle of approximately 40 degrees with respect to the sheet transport direction "A". The sheets slide until coming to rest against a lower stop of known type (not depicted). In collecting station 9, the sheets are oriented in known fashion against the lower stop and against a lateral delimiter (not depicted), by an orienting mechanism of known type (not depicted), into a sheet stack 10 with aligned edges.

Arranged in the region of the lower stop of collecting station 9, and oriented perpendicular to its depositing surface, are stapling devices 6 and 7 which are attached to a support 3. As shown in particular by FIG. 2, all the subassemblies necessary for the operation of stapling devices 6 and 7 are arranged on support 3. Support 3 comprises two walls 20, 21 which are rigidly joined to one another by a crossmember 22, a shaft 8, and a guide tube 23 arranged parallel to the latter. Shaft 8 is mounted at each of its two ends to a flange 17 attached to the housing 2 of the apparatus.

Two holders 4 and 5 of identical configuration are arranged displaceably on shaft 8 by suitable bearings 35 of known type. Attached to each of holders 4 and 5, by screw connections 46 and 47, are mounting plates 44 and 45, on each of which a stapling device 6 and 7, including gear drives (not depicted) and drive motors 18 and 43, are releasably attached. Stapling devices 6 and 7 are equipped with holes into which securing bolts of known type (not depicted), arranged on mounting plates 44 and 45, positively engage. Stapling devices 6 and 7 are each attached by means of manually actuatable screws 33 and 34 to mounting plates 44 and 45, and are arranged thereon so that they drive a staple from below into sheet stack 10 arranged in collecting station 9.

Figure 3:
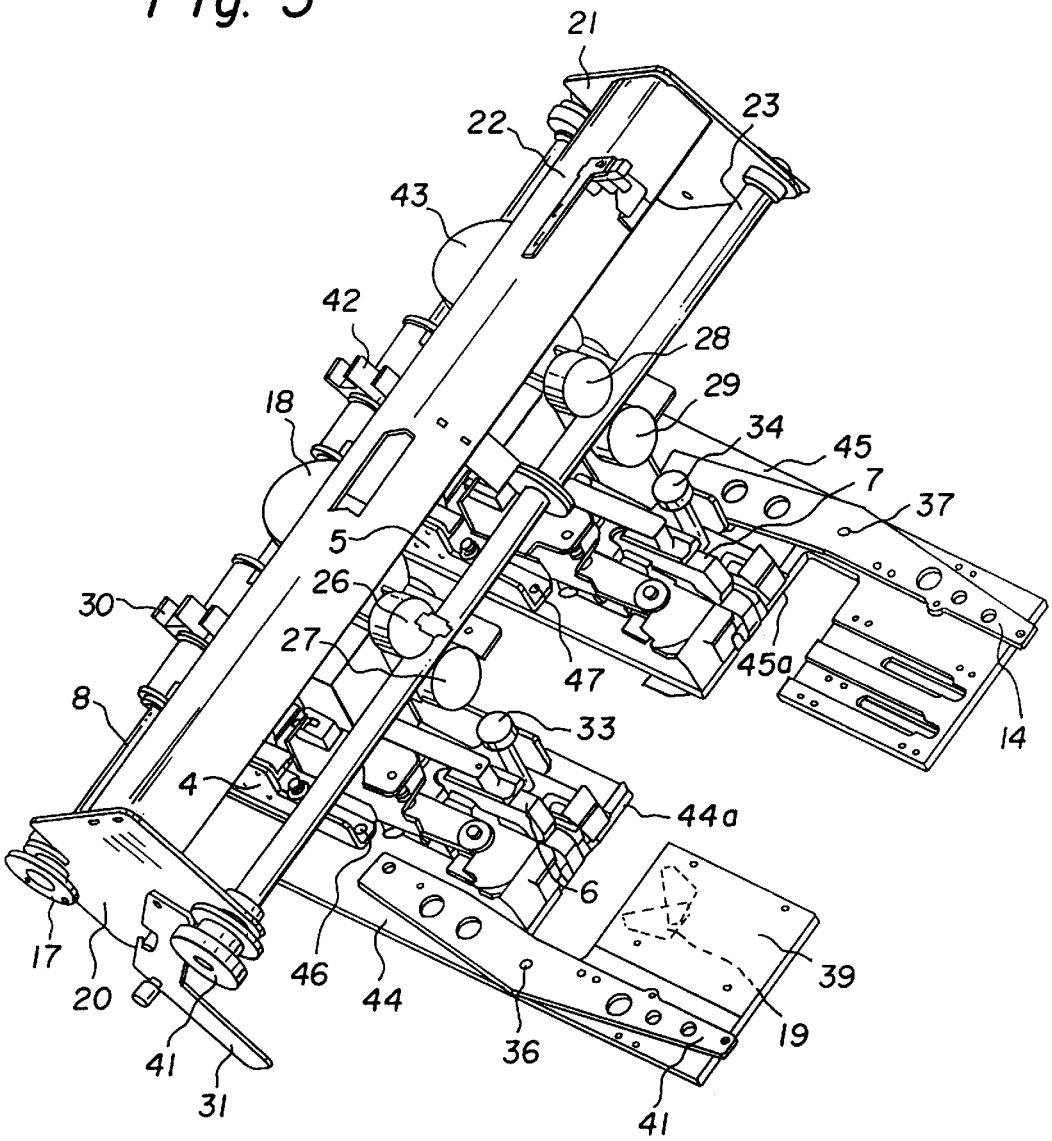
FIG. 3 is a view of the device according to FIG. 2 in the service position.

A countermember 39 (only one of the countermembers 39 is depicted in FIG. 3), which is also arranged on mounting plates 44 and 45, is associated with stapling devices 6 and 7. Arranged on each of countermembers 39 is a bending device 19 (not described in further detail) of known type, which, in a known manner (not depicted), bends over the staple ends emerging from sheet stack 10 and lays them against the back of sheet stack 10. Bending device 19 is actuated by levers 14 and 41 which are pivotable about bearings 36 and 37 and can be moved by the drive device of stapling devices 6 and 7.

Figure 2:
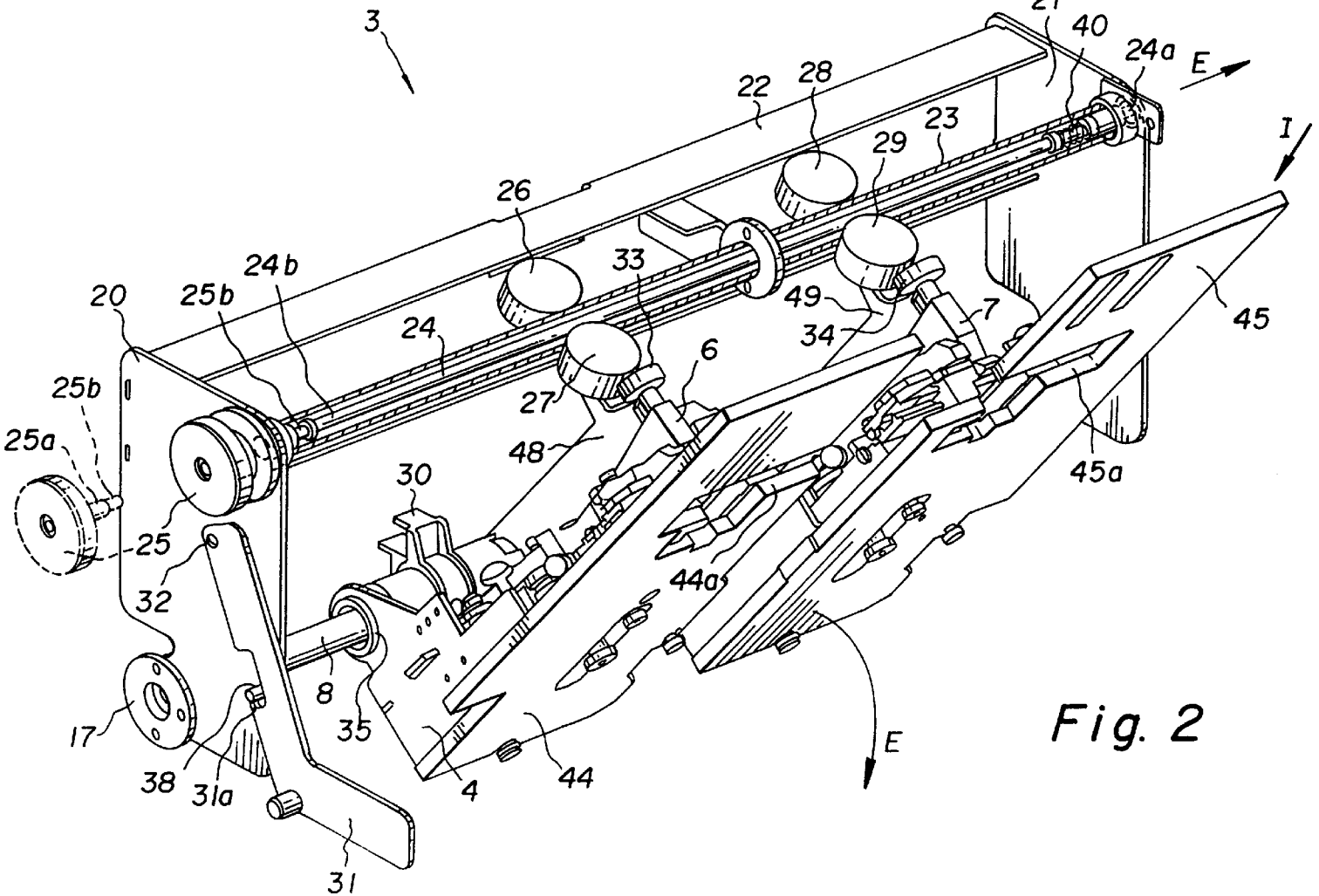
FIG. 2 is a view of a portion of the device according to FIG. 1, in an oblique view and in the operating position.

Mounting plates 44 and 45 are equipped with recesses 44*a* and 45*a*, visible in particular in FIGS. 2 and 3, which are partly covered by movable stops (not depicted). As mentioned earlier, the stops serve as the lower delimiter of collecting station 9, and after completion of the collecting or stapling operation, and after sheet stack 10 has been grasped by a transport gripper of known type (not depicted), for example as described in German Offenlegungsschrift 38 39 297, are moved downward so that sheet stack 10 moves through recesses 44*a* and 45*a* and can be deposited on a vertically movable depositing table 12.

Bearing arms 48 and 49, on each of which a pair of guide rollers 26, 27 and 28, 29 is rotatably mounted, are attached to each of holders 4 and 5. Guide rollers 26, 27 and 28, 29 rest against guide tube 23, and provide parallel guidance for holders 4 and 5. The rotation axes of guide rollers 26, 27 and 28, 29 are arranged eccentrically with respect to their outside diameter, and are configured in adjustable fashion (not depicted) such that the angular position of holders 4 and 5, and thus the position of stapling devices 6 and 7, can be adjusted with respect to one another.

Support 3 can be locked, in its position I associated with the operating position of stapling devices 6 and 7, on the housing 2 of the apparatus. For this purpose, a locking rod 24, which is acted upon opposite to the direction of the arrow "E" at its rear end 24*a* by a spring 40, is arranged displaceably in guide tube 23. A locking element 25, which has a threaded pin 25*a* and a projection 25*b*, is associated with front end 24*b* of locking rod 24. Locking element 25 can be screwed into a receiving element (not depicted) which is accessible from the outside of the apparatus and is attached on the housing 2 of said apparatus such that projection 25*b* engages on front end 24*b* of locking rod 24.

When locking element 25 is screwed into the associated receiving element, support 3 is immobilized in its position on the front wall of the housing 2 of the apparatus by the fact that projection 25*b* of locking element 25 engages positively into the hole in guide tube 23. At the same time, locking rod 24 is displaced against the force of spring 40 in the direction of the arrow "E" until its rear end 24*a* comes positively into engagement in an opening (not depicted) on the rear wall of the housing 2 of the apparatus. In the locked operating position (position I) as shown in FIG. 2, a snap projection 31*a* of a latch lever 31 engages beneath a pin 38 attached to wall 20 of support 3. Latch lever 31 is mounted pivotably about a bearing 32 on the housing 2 of the apparatus, and comes into engagement with pin 38 under its own weight.

In the region of shaft 8, holders 4 and 5 are each equipped with a U-shaped follower 30 and 42, which are continuously in engagement with a follower device (not depicted) of the apparatus, which is mounted in stationary fashion, can be driven parallel to shaft 8, and serves to establish the desired stapling positions. The follower device is constituted by a motor-driven endless belt which is in positive engagement (not depicted) with followers 30 and 42. Followers 30 and 42 are arranged to be positively displaceable in the axial direction together with holders 4 and 5, but not pivotable.

In order to unlock support 3, locking element 25 is unscrewed and support 3 is simultaneously grasped by hand at a mounting plate 44 or 45 and lifted slightly. Pin 38 is thereby disengaged from hook-shaped snap projection 31*a*, whereupon latch lever 31 pivots and support 3 can be manually lowered into its service position (position II). If support 3 should inadvertently not be held onto when locking element 25 is unlocked, support 3 will be kept from falling by latch levers 31, 31*a*, and can then be released by latch lever 31 as described.

As is evident in particular from FIG. 1, stapling devices 6 and 7 are arranged in their operating positions (position I), inside apparatus 1 in a location that is inaccessible from outside. When support 3 is then swung downward as intended into the service position (position II), stapling devices 6, 7 enter into a depositing area 13, accessible from outside, so that they can be reached for servicing purposes. Depositing area 13 of apparatus 1, in which a depositing table 12, vertically movable in known fashion, is arranged for stacked deposition of sheet stacks, is accessible through a door (not depicted). When the door is open and depositing table 12 is moved down, support 3 assumes, in the service position (position II), the lower horizontal position depicted in FIGS. 1 and 3, in which stapling devices 6 and 7 as shown in FIG. 3 are arranged so as to be easily accessible from above, so that access can be gained to mounting plates 44, 45, stapling devices 6 and 7, and their countermembers 39, easily and with no great expenditure of time. Since stapling devices 6 and 7 remain coupled to the adjusting device by means of followers 30 and 42 even in the service position, the latter can be moved into a position favorable for service.

Removal of stapling devices 6 and 7 is effected by simply undoing screws 33 and 34 and lifting them out of the securing bolts of mounting plates 44 and 45. Stapling devices 6 and 7 are inserted, just as easily, by reversing the sequence. It is equally easy to detach countermembers 39, which are attached to mounting plates 44 and 45 by means of threaded connections. It is also possible to remove mounting plates 44 and 45 from holders 4 and 5 by undoing threaded connections 46 and 47, so that the entire subassembly 6, 18, 39, 41 or 7, 14, 39, 43, 45 can be serviced outside apparatus 1.

Once a service operation has been completed, support 3 is manually swung upward, causing latch lever 31 to overrun pin 38 and swing underneath it. Support 3 is locked to the front and rear sides of the housing 2 of the apparatus by screwing in locking element 25 in the manner described, and is then, without additional adjustment work, once again in its correct operating position (position I), in which stapling devices 6 and 7 are immediately ready for operation again.

In a deviation from the embodiment depicted, the pivoting movement of support 3 can also occur differently. It is possible, for example, to equip shaft 8 with a coupling, accessible from the outside of the apparatus, to which an actuation lever (not depicted) can be applied, by means of which support 3 can be moved into its two positions I and II.

In order to allow motorized displacement of support 3, it is also possible, in the case of another proposal (not depicted) which deviates from the embodiment depicted, to arrange on one of walls 20 or 21 of the support a tooth set, arranged concentrically with the rotation axis of shaft 8 and shaped like a segment of a circle, into which a gear of a motorized gear drive, arranged on the apparatus, engages and is activated as necessary. It is also possible (but not depicted) to damp the lowering movement of support 3 by means of a braking mechanism, for example a gas spring, articulated onto it. In a deviation from the embodiment depicted, in which support 3 can be moved into a service position by pivoting about shaft 8, a correspondingly configured support for stapling devices 6 and 7 can also be brought, by a rotary movement or also by displacement (not depicted), into a position in which stapling devices 6, 7 are positioned in easily accessible fashion inside or also outside the apparatus.

The invention has been described in detail with particular reference to certain preferred embodiments thereof, but it will be understood that variations and modifications can be effected within the spirit and scope of the invention.

What is claimed is:

1. Apparatus for stapling sheets which are deposited one on top of another in stacked form, said sheet stapling apparatus including a stapling device having a locked operating position and a service position and arranged inside a closed housing of the apparatus, comprising:

said stapling device arranged on a movable support which is locked with a locking element affixed to said housing, said locking element locking said stapling device in a first position associated with the locked operating position of said stapling device; and said movable support being movable into a second position associated with said service position of said stapling device; and, a latch lever mounted to said closed housing, said latch lever positively engaging a pin attached to said movable support in order to secure said movable support against inadvertent movement when said locking element is unlocked, wherein said latch lever is mounted rotatably on said housing of said stapling apparatus.

2. Apparatus for stapling sheets as defined in claim 1, wherein said movable support comprising a holder is mounted pivotably about a shaft, said holder being arranged on said shaft for releasably attaching said stapling device.

3. Apparatus for stapling sheets defined in claim 2, wherein said holder with said stapling device attached thereon is guided displaceably on said shaft and can be adjusted to different stapling positions.

4. Apparatus for stapling sheets as defined in claim 3, wherein said stapling device can be pivoted from said operating position, associated with sheets to be stapled which are deposited in a collecting station, in said second position remote from said collecting station, in which said stapling device can be positioned in an area inside said housing of said sheet stapling apparatus which is accessible from outside said housing.

5. Apparatus for stapling sheets as defined in claim 4, wherein said support comprises two parallel walls joined to one another by a crossmember;

said shaft being attached to said parallel walls and projecting through said parallel walls of said movable support serve as pivot bearings for said movable support on said housing of said sheet stapling apparatus; and a guide tube attached to said two parallel walls, which provides parallel guidance of said holder and of said stapling device attached thereto, is arranged parallel to said shaft.

6. Apparatus for stapling sheets as defined in claim 5, wherein a locking rod, one end of which can be brought positively into engagement, against a spring preload, with a wall of said housing of said sheet stapling apparatus and locks said movable support on said wall, is mounted displaceably in said guide tube; and a locking element, which moves said locking rod and can be screwed in from the outer side of said housing of said apparatus, engages on an end opposite said one end of said locking rod and positively locks said support on said wall facing the user.

7. Apparatus for stapling sheets as defined in claim 6, wherein a pair of guide rollers, associated with opposing sides of said guide tube and providing guidance of said holder and said stapling device, is rotatably mounted on said holder.

8. Apparatus for stapling sheets as defined in claim 7, wherein said pair of guide rollers have a rotation axes configured adjustably in order to set the locking operating position of said stapling device.

9. Apparatus for stapling sheets as defined in claim 8, wherein a mounting plate on which said stapling device can be immobilized in a precise position by positive connections and can be attached by a screw, is attached to said holder by a threaded connection.

10. Apparatus for stapling sheets as defined in claim 9, wherein said holder has mounted thereon a U-shaped follower which is continuously in positive engagement with a follower mechanism, movable parallel to said shaft and arranged on said sheet stapling apparatus.

11. Apparatus for stapling sheets defined in claim 10, wherein said support can be positioned in its second position such that said holder and said stapling device project into a depositing area for deposited sheets or sheet stacks.

12. Apparatus for stapling sheets as defined in claim 11, wherein two holders with stapling devices, guided displaceably on said shaft and adjustable to different stapling positions, are arranged on said support.

* * * * *